US005524790A

United States Patent [19]

Cho

[11] Patent Number: 5,524,790

[45] Date of Patent: Jun. 11, 1996

[54] APPARATUS FOR GUIDING FOOD DISCHARGED FROM AN AUTOMATIC VENDING MACHINE

[75] Inventor: Wan Je Cho, Busan, Rep. of Korea

[73] Assignee: LG Industrial Systems Co., Ltd., Seoul, Rep. of Korea

[21] Appl. No.: 257,126

[22] Filed: Jun. 9, 1994

[30] Foreign Application Priority Data

Jun. 12, 1993 [KR] Rep. of Korea ..... 10319/1993 U
Jun. 29, 1993 [KR] Rep. of Korea ..... 11666/1993 U

[51] Int. Cl.[6] ..... A24F 27/14

[52] U.S. Cl. ..... 221/150 HC; 221/264

[58] Field of Search ..... 221/150 HC, 150 R, 221/150 H, 191, 151, 152, 249, 248, 264

[56] References Cited

U.S. PATENT DOCUMENTS 4,960,226 10/1990 Ehrle ..... 221/264

FOREIGN PATENT DOCUMENTS 3-163690 7/1991 Japan ..... 221/150 HC
3-104287 10/1991 Japan .

*Primary Examiner*—Kenneth Noland
*Attorney, Agent, or Firm*—Oliff & Berridge

[57] ABSTRACT

An apparatus for guiding food discharged from an automatic vending machine. The apparatus comprises a guide plate fixed to a front end of a lower shutter, which is adapted to be moved back and forth to discharge easily heated food, and a guide bracket provided under a heating unit, which is adapted to guide the guide plate and the food. Since the guide plate pushes food to a discharging outlet when the heated food falls down into the guide bracket so that the user can easily take out the food of the outlet. Since it is not necessary to increase an inclined angle of the guide plate, height of the discharging part can be reduced. Hence, receptive capacity of a food stacking part is relatively increased as compared with the same sized machine.

9 Claims, 10 Drawing Sheets

APPARATUS FOR GUIDING FOOD DISCHARGED FROM AN AUTOMATIC VENDING MACHINE

BACKGROUND OF THE INVENTION

1. Field of the Invention

The present invention relates to an apparatus for guiding articles of food discharged from an automatic vending machine, and more particularly to an apparatus for guiding articles of food discharged from an automatic vending machine, which is designed to allow the user to take out easily the guided articles of food which were frozen in a freezing storage part or heated in a heating unit.

2. Description of the Prior Art

FIG. 1 is a side elevational view in section which shows schematically a conventional automatic vending machine (disclosed in Japanese Utility model Laid-open Publication No. Heisei 3-104287 (published on Oct. 29, 1991)).

As illustrated in the drawing, there is provided a hollow hexahedral cabinet 10. The cabinet 10 is provided at its upper part with a freezing storage part 20. A food heating unit 40 which is adapted to heat articles of food fallen from the freezing storage 20 is located under the freezing storage part 20 and at a lower part of the cabinet 10. Provided below the freezing storage part 20 is a heating and dispensing part 30 for dispensing heated articles of food. The heating and dispensing part 30 has a guiding bracket 60 to guide discharge of food heated by the heating unit 40.

The freezing storage part 20 is usually maintained in the temperature of −18° C. to −20° C. and contains therein a plurality of food stacking receptacles 21 spaced from one another at predetermined distance. A chute 22 is provided under the food stacking receptacles 21 so that the articles of food in the food stacking receptacles 21 fall down to the heating unit 40.

The heating unit 40 is provided at its upper and lower ends with an upper shutter 41 and a lower shutter 42 which are capable of sliding laterally so that the upper and lower shutters 41 and 42 open or close an upper inlet and a lower outlet of the heating unit 40. Accordingly, when an article of food falls down from the freezing storage part 20, the upper shutter 41 is opened to permit the article to pass therethrough and just after the passage is closed. The article in the heating unit 40 is then heated for about one minute by a heating device such as a magnetron (not shown). Thereafter, the lower shutter 42 is opened so that the heated article falls down into the guiding bracket 60 along a guide slope plate **60*b* of the guiding bracket 60** to be taken out of the bracket.

As described above, since article of food heated in the heating unit 40 falls down freely and is received in the guiding bracket 60, the user can take out the article through a discharging outlet **60*a***.

Reference numerals, 45 and 46 not described designate pinions which are rotated by a driving motor (not shown). Also, reference numerals 47 and 48 designate racks which are engaged with the pinions 47 and 48 respectively to cause the upper and lower shutters 41 and 42 to slide.

However, if the above-mentioned conventional automatic vending machine deals with fatty food such as fried potato, fried drumstick of chicken, hamburger and the like, the guide slope plate must have a rapid inclined angle of at least 45° in order to cause the article of food to fall down smoothly during its discharge, whereby the guiding bracket 60 is increased in its height. Hence, when the automatic vending machine is designed to have a fixed height, the stacking receptacles 21 are decreased in its height, thereby decreasing receptive capacity for food.

Furthermore, since articles of food sold by the abovementioned automatic vending machine are very fatty and wet, the slope plate **60*b* is gradually smeared and deposited with fat and moisture. As the fat and moisture are deposited on the slope plate for a long time, the heated food is hard to slide smoothly along the slope plate, so that the food is caught by the deposited fat and moisture. Hence, since the user must put deep his hand into the discharging outlet 60*a*** in order to take out the caught food, the conventional automatic vending machine is troublesome in use.

SUMMARY OF THE INVENTION

The present invention has been made in view of the above-described problems occurring in the prior art and an object of the invention is to provide an apparatus for guiding food discharged from an automatic vending machine which can discharge smoothly heated and cooked articles of food without increase of an inclined angle of a slope plate and also can increase relatively height of food stacking receptacles by decreasing height of a discharge part.

Another object of the invention is to provide an apparatus for guiding food discharged from an automatic vending machine which is adapted to prevent deformation of a guide slope plate due to careless or mischief of the user.

In accordance with the present invention, the object mentioned above can be accomplished by providing an apparatus for guiding food discharged from an automatic vending machine which comprises a guide plate fixed to a front end of a lower shutter, which is adapted to be moved back and forth to discharge easily heated food, and a guide bracket provided under a heating unit, which is adapted to guide the guide plate and the food.

BRIEF DESCRIPTION OF THE DRAWINGS

These and other objects, features and advantages of the invention will become more apparent upon a reading of the following detailed specification and drawings, in which.

DETAILED DESCRIPTION OF THE PREFERRED EMBODIMENTS

Figure 1:
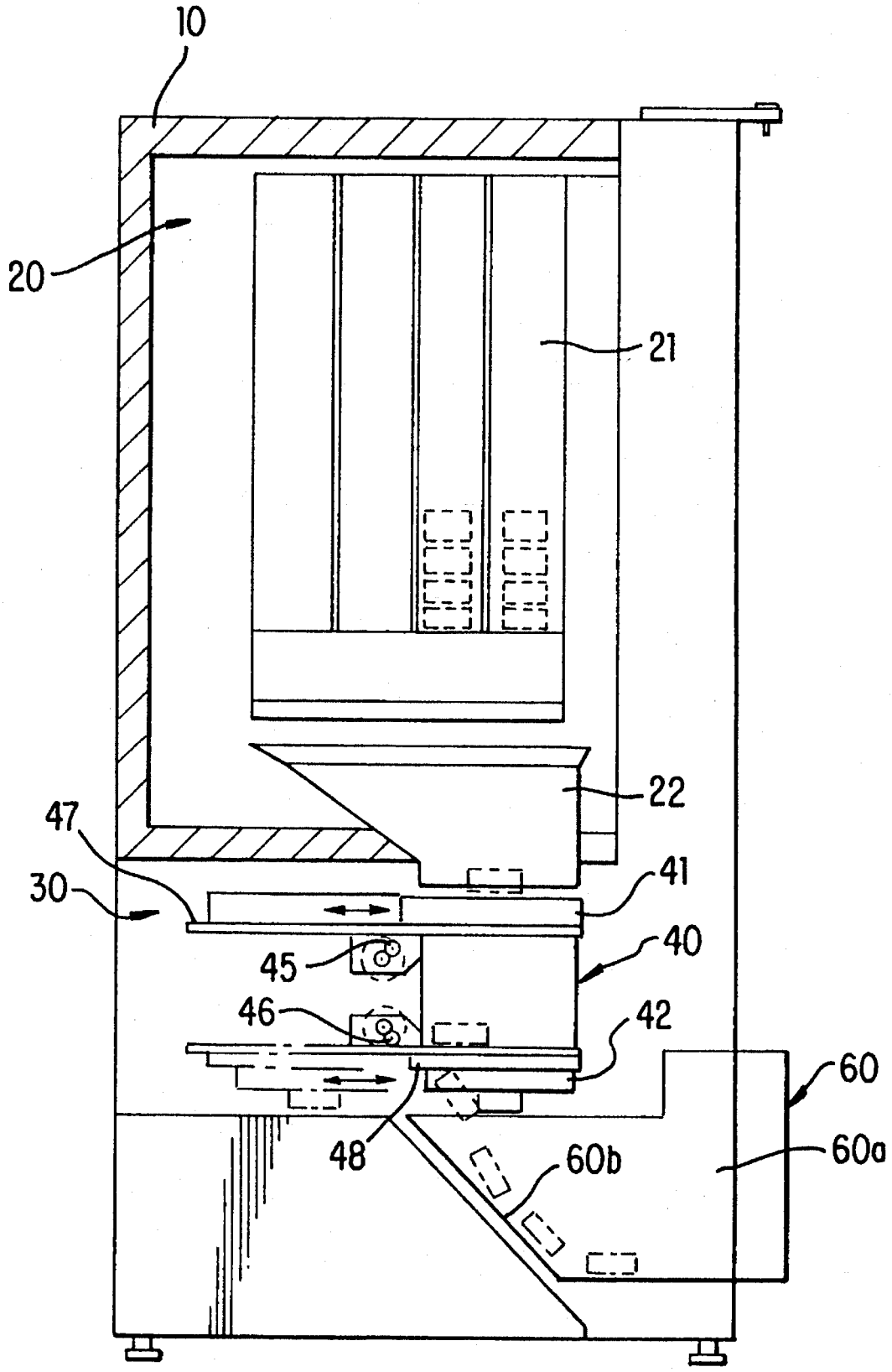
FIG. 1 CONVENTIONAL ART
FIG. 1 is a side sectional view of a conventional automatic vending machine wherein a front door is eliminated.

The structure of an apparatus for guiding food discharged from an automatic vending machine according to the invention will be described with reference to FIGS. 2 and 3 hereinafter. In the structure of the present invention, elements corresponding to those in the conventional structure are denoted by the same reference numerals. For simplicity of the description, the elements will be briefly described in the following description.

As illustrated in the drawings, the automatic vending machine according to the invention has a hollow hexahedral cabinet 10. The cabinet 10 is provided at its upper part with a freezing storage part 20. The cabinet 10 is also provided at its lower part with a heating and dispensing part 30 including a food heating unit 40 for heating an article of food fallen from the freezing storage part 20 and a guiding bracket 70 for guiding the discharged article of food which has been heated in the heating unit 40.

The freezing storage part 20 contains therein a plurality of food stacking receptacles 21 spaced from one another at a predetermined distance. Located under the food stacking receptacles 21 is a chute 22 thorough which an article of food selected by the user falls down from the freezing storage part 20 into inside of the heating unit The heating unit 40 is located at a center position of the heating and dispensing part 30. The heating unit 40 is provided at upper and lower ends with upper and lower shutters 41 and 42, respectively. The upper and lower shutters 41 and 42 are slidably mounted on guide rails 43 and 44 fixed to the cabinet 10. More specifically, the heating unit 40 has a driving motor (not shown) fixed to a rear position thereof. The driving motor is connected to driving gears 45*a* and 46*b* engaged with pinions 45 and 46. The guide rails are also fixed to rear brackets 49 and 50, respectively. The pinions 45 and 46 are rotatably fixed to the rear brackets 49 and 50, respectively. The pinions 45 and 46 are respectively engaged with racks 47 and 48 attached to the upper and lower shutters 41 and 42. Therefore, as the motor is activated in a normal direction or a reverse direction, the upper and lower shutters 41 and 42 are slid back and forth along the guide rails 43 and 44 to open and close upper and lower openings of the heating unit 40. In addition to the above-described general structure of the automatic vending machine, the present invention provides an apparatus for guiding food discharged from an automatic vending machine which will be described in detail hereinafter.

Figure 4:
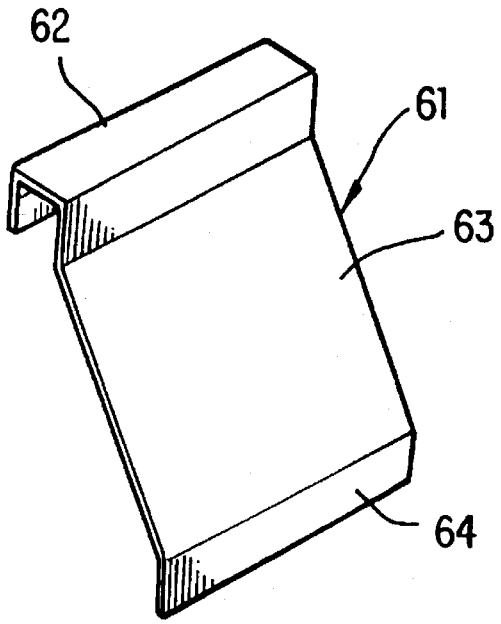
FIG. 4 is a perspective view of an embodiment of a guide slope plate according to the invention.
Figure 5:
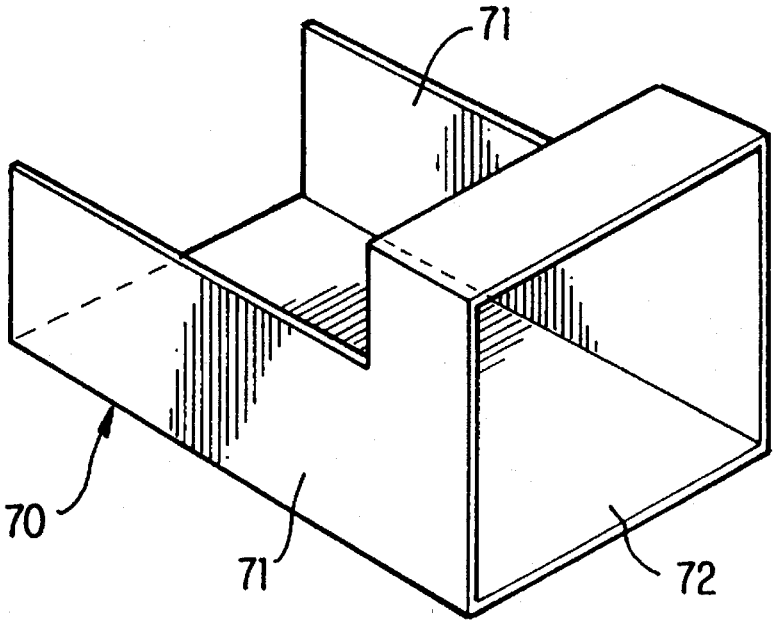
FIG. 5 is a perspective view of an embodiment of a guide bracket according to the invention.

Referring to FIGS. 4 and 5, there are shown a guide slope plate and a guide bracket which are essential components of the apparatus of the present invention. As illustrated in drawings, the apparatus for guiding food discharged from a vending machine according to the invention comprises the guide bracket 70 and a guide slope plate 61 received in the guide bracket 70 and moved back and forth.

First of all, the guide slope plate 61 of the invention will now be described with reference to FIG. 4.

Figure 2:
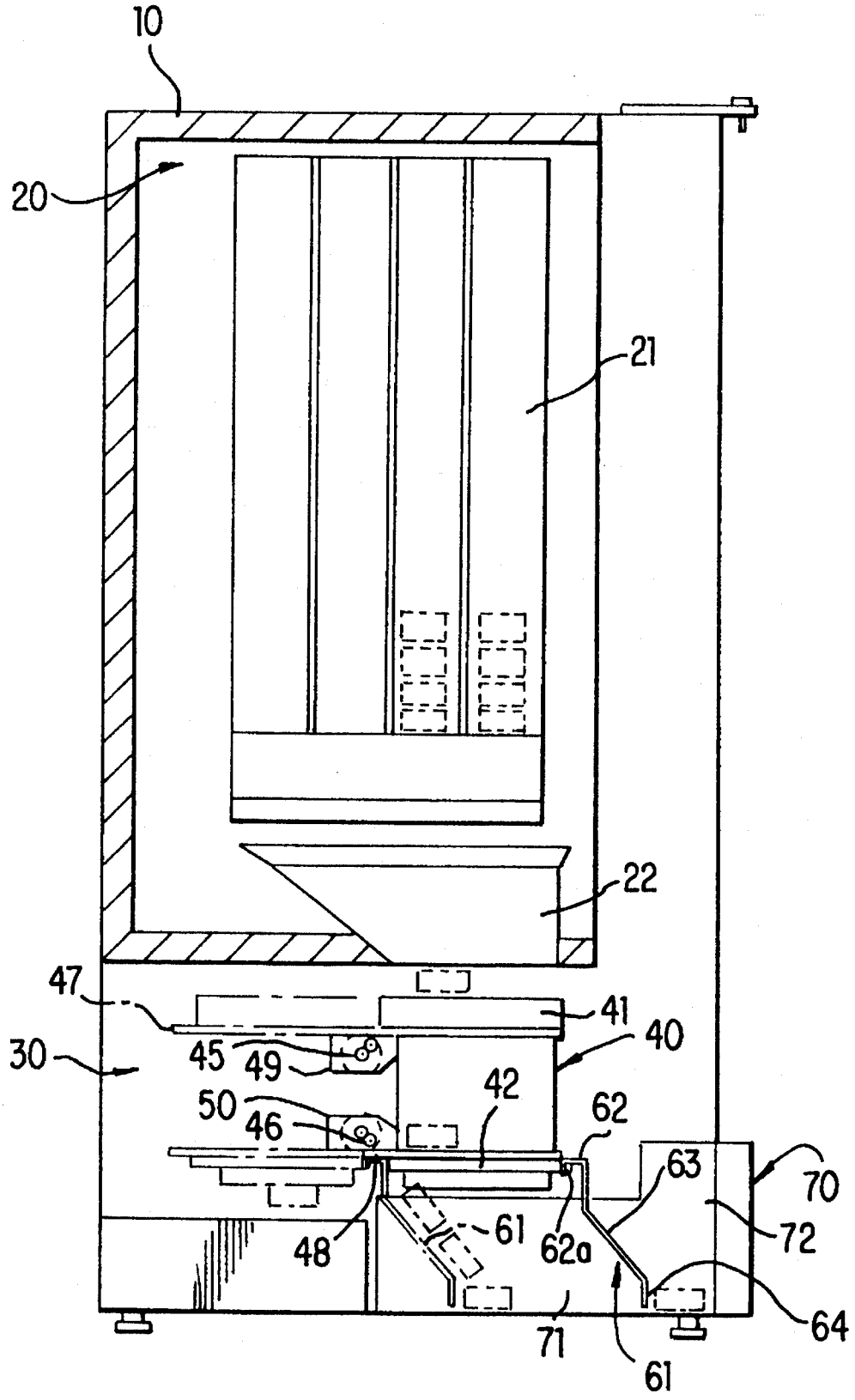
FIG. 2 is a side sectional view of an automatic vending machine having an apparatus according to the invention wherein a front door is eliminated.

The guide slope plate 61 is formed at its upper end with a fixing portion 62 having an inverted "U" shape in section which is adapted to be fixed to a front end of the lower shutter 42 (see FIG.2). The fixing portion 62 is integrally formed at its lower end with a slope portion 63 extending forward and downward. The slope portion 63 is integrally formed at its lower end with a pusher portion 64.

As described above, the guide slope plate 61 is fixed to the front end of the lower shutter 42 by means of bolts 62*a* (see FIG. 2). Although the guide slope plate 61 is described as fixed to the lower shutter by means of the bolts 62*a* in this specification, the guide slope plate 61 may also be fixed by means of another fixing means such as welding.

Referring to FIG. 5, there is shown an embodiment of the guide bracket according to the invention.

The guide bracket 70 has two side walls 71 formed at both sides and extending upward and a top wall 71*a* formed at front portions of upper ends of the side walls 71 to define a discharging outlet 72.

An operation of the above-constructed apparatus for guiding articles of food discharged from an automatic vending machine according to the invention will now be described.

Figure 3:
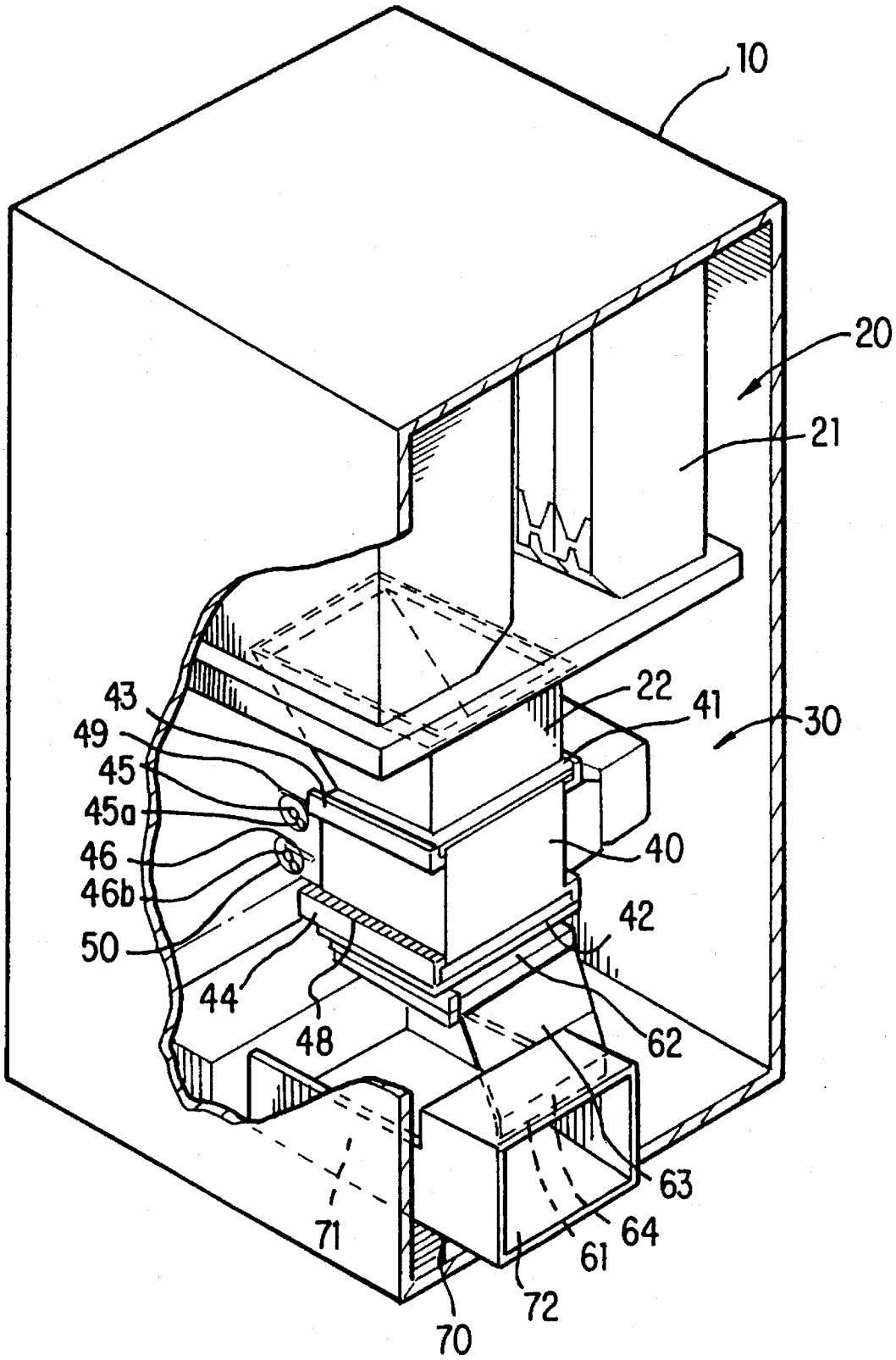
FIG. 3 is a partially cutaway view in perspective of the automatic vending machine of FIG. 2.

As illustrated in FIGS. 3 to 5, the upper and lower shutters 41 and 42 are closed when the vending machine is in a non-operation condition. When the user operates the machine in order to buy required food, an article of food contained in the food stacking receptacles 21 of the freezing storage part 20 falls down into the heating unit 40 through the chute 22. At this time, the driving motor (not shown) provided at a rear position of the heating unit 40 is activated to rotate the upper pinion 45, so that the upper rack 47 engaged with the upper pinion 45 is moved rearward. As the upper rack 47 is moved rearward, the upper shutter 41 fixed to the upper rack 47 is slid into a position denoted by the dot and dash line (see FIG. 2) so that the upper inlet of the heating unit 40 is opened, thereby permitting the fallen article to fall down into the heating unit 40.

After the article has fallen into the heating unit 40, the upper pinion 45 and the upper rack 47 are operated in the opposite direction so that the upper shutter 41 is slid into the original position to close the upper inlet of the heating unit 40. Thereafter, the article of food in the heating unit 40 is heated by the heating device.

After the article has been completely heated, the lower pinion 46 is rotated by activation of the driving motor and thus the lower rack 48 engaged with the lower pinion 46 is slid rearward. As the lower rack 48 is slid, the lower shutter 42 fixed to the lower rack 48 is moved into a position denoted by the dot and dash line (see FIG. 2) so that the lower outlet of the heating unit 40 is opened, thereby permitting the article to fall down into the guide bracket 70.

Thereafter, the lower pinion 46 and the lower rack 48 are operated in the opposite direction so that the lower shutter 42 is returned into the original position to close the outlet of the heating unit 40.

More, concretely stated, after the article has been received into the heating unit 40, the lower shutter 42 is initially in the closed position denoted by the solid line in FIG. 2 and the guide slope plate 61 fixed to the front end of the lower shutter 42 is located at front portion of the guide bracket 70.

As the lower shutter 42 is moved rearward after completion of heating for the article, the guide slope plate 61 fixed to the front end of the lower shutter 42 is also moved rearward, that is the guide slope plate 61 is moved to the position denoted by the dot and dash line in FIG. 2. Thereafter, the article falling from the heat unit 40 is directed to guide bracket 70 along the slope portion 63 of the guide slope plate 61. Thereafter, as the lower shutter 42 is moved forward to close the lower outlet of the heating unit 40, the guide slope plate 61 is also moved forward together with the lower shutter 42. Therefore, the article of food fallen in the guide bracket 70 is pushed to the discharging outlet 72 by the pusher portion 64 of the guide slope plate 61 so that the user can easily take out the article of the guide bracket 70.

However, the above-described apparatus for guiding food discharged from a vending machine according to the invention has a disadvantage in that when the user deforms the guide slope plate 61 by pushing or pulling the slope plate rearward or forward with mischief while taking out the article of the discharging outlet 72 of the guide bracket 70, the guide slope plate 61 can not play its own role sufficiently.

In order to prevent the deformation of the guide slope plate 61, the present invention also provides several types of apparatuses having different means for preventing the deformation of the slope plate, as shown in FIGS. 6 to 10. Embodiments of the means for preventing deformation of the slope plate according to the invention will now be described with reference to FIGS. 6 to 10.

Figure 6:
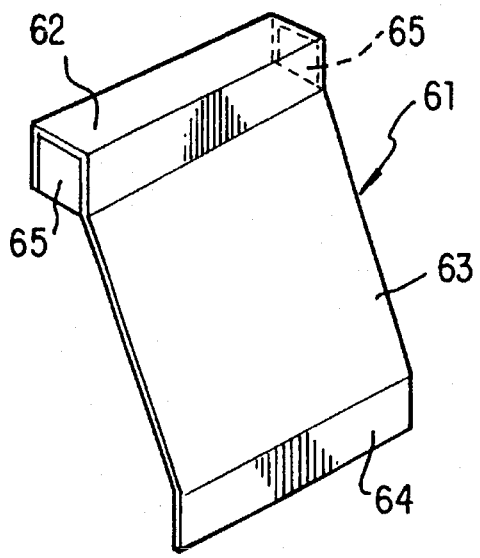
FIG. 6 is a perspective view of another embodiment of a guide slope plate according to the invention.

Referring to FIG. 6, there is shown another embodiment of the guide slope plate according to the invention.

The guide slope plate 61 has a fixing portion 62 having an inverted "U"-shape in section. The fixing portion 62 is attached at its both ends with rectangular reinforcing plates 65 by welding in order to increase strength of the slope plate portion 63. Therefore, even though the user pushes or pull the guide slope plate 61 during takeout of an article of food, the guide slope plate 61 can not be deformed by the reinforcement of the plates 65. In general vending machine, the guide slope plate 61 is usually made of synthetic resin.

Referring to FIGS. 7 to 10, there are shown another embodiment of means for preventing deformation of the guide slope plate. As shown in the drawing, a connecting plate 82 is mounted on the side walls 71 of the guide bracket 70. The connecting plate 82 is bent downward at its both ends and the both ends are fixed to the side walls 71 by means of bolts **82*a*. An angle iron 81 having an acute angle in section is attached at a branched plate thereof to the rear end of the connecting plate 83 by using fixing means such as welding. At this time, the other branched plate of the angle iron 81 is designed to have an inclined angle equal to that of the slope plate portion 63 so that the slope plate portion 63 comes into contact with the other branched plate of the angle iron 81 when the guide slope plate 61 is moved forward. Therefore, the slope plate portion 63 of the guide slope 61 is reinforced by the contact with the angle iron 81**.

Figure 7:
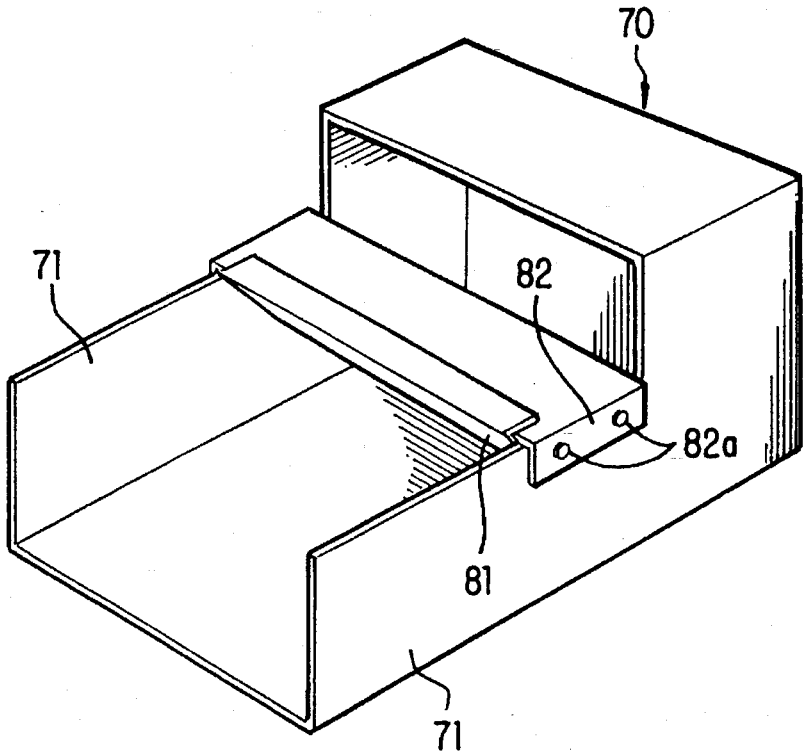
FIG. 7 is a perspective view of another embodiment of a guide bracket according to the invention.
Figure 8:
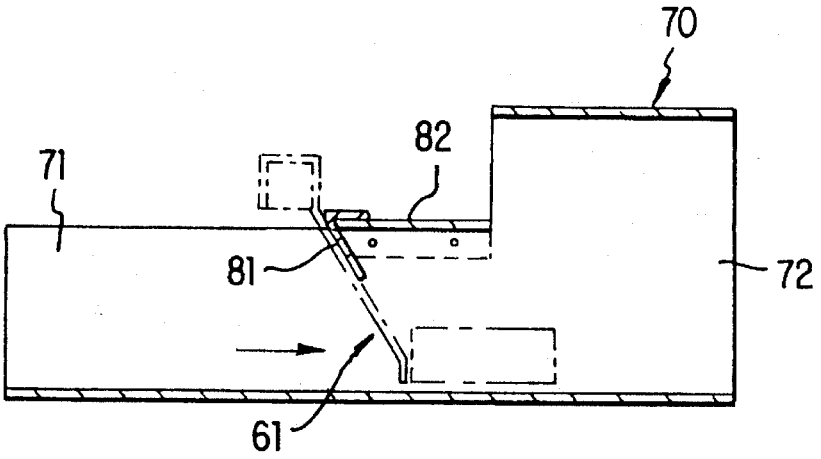
FIG. 8 is a sectional view showing guiding operation of the guide plate shown in FIG. 6 and the guide bracket shown in FIG. 7.
Figure 9:
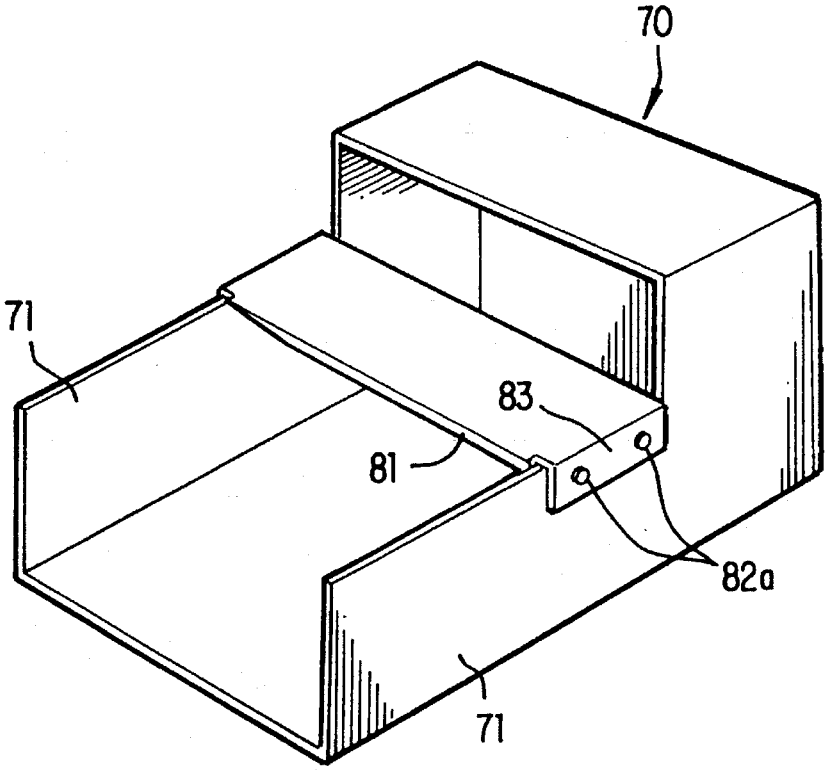
FIG. 9 is a perspective view of still another embodiment of a guide bracket according to the invention.
Figure 10:
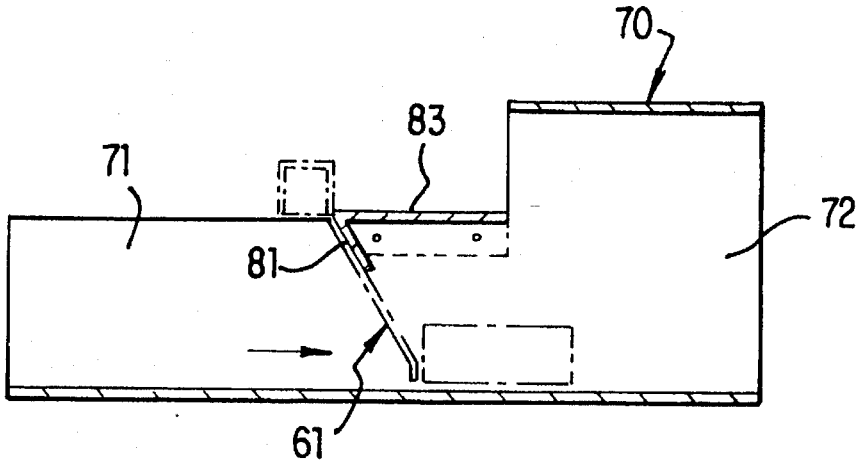
FIG. 10 is a sectional view showing guiding operation of the guide plate shown in FIG. 6 and the guide bracket shown in FIG. 9.

In the above embodiment, although the angle iron 81 is formed separately from the connecting plate 82 as shown in FIGS. 7 and 8, the angle iron may be integrally formed with the connecting plate 83 as shown in FIGS. 9 and 10.

As described above, when the guide slope plate 61 has been moved to the acute angle iron 81, it comes into contact with whole surface of the free plate of the angle iron 81 because the guide slope plate 61 has an inclined angle equal to that of the free plate of the angle iron 81. Hence, the slope plate 61 is positively supported by the angle iron 81, so that it is possible to reduce or prevent deformation of the guide slope plate 61.

Figure 11:
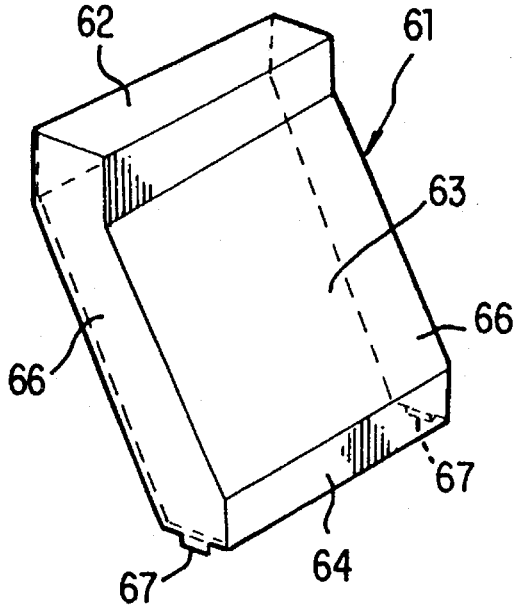
FIG. 11 is a perspective view of another embodiment of a guide slope plate according to the invention.
Figure 12A:
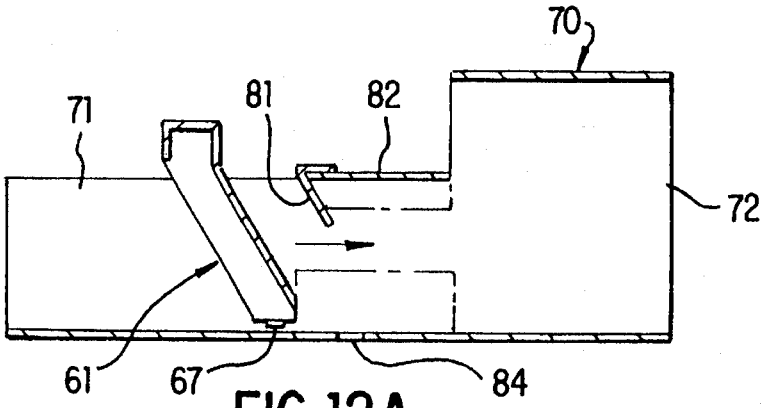
FIGS. 12A to 12D are sectional views showing guiding operation of the guide plate shown in FIG. 11 and the guide bracket shown in FIG. 7.
Figure 12B:
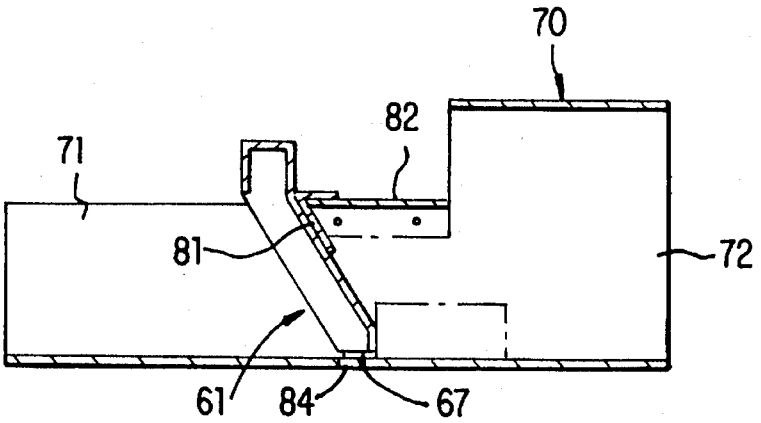
Figure 12D:
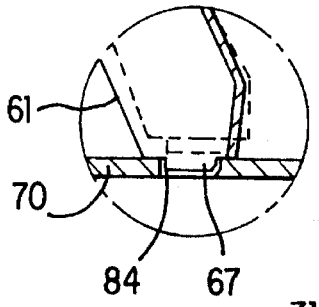

Referring to FIGS. 11 to 12D, there are shown still another embodiment of means for preventing deformation of the guide slope plate. As illustrated in the drawings, a pair of side plate 66 and 66 are formed at both sides of the guide slope plate 61 and each of the side plates 66 is integrally formed at its lower end with a protrusion 67. The guide bracket 70 is formed at its bottom plate with fitting holes 84 and 84 such that the protrusions 67 of the side plates 66 are fitted into the fitting holes 84 when the guide slope plate 61 is completely moved forward.

Figure 12C:
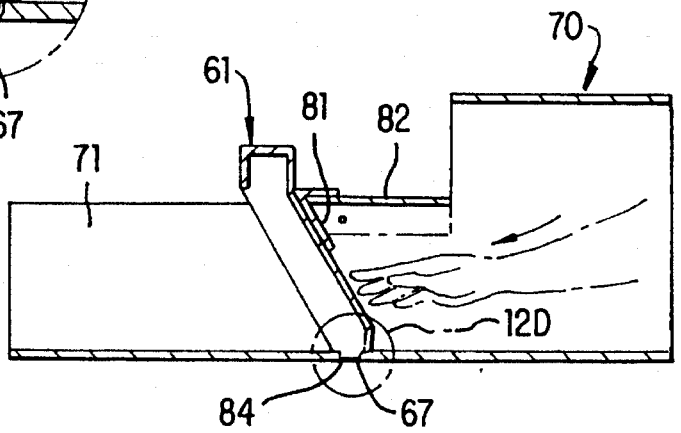
Figure 13:
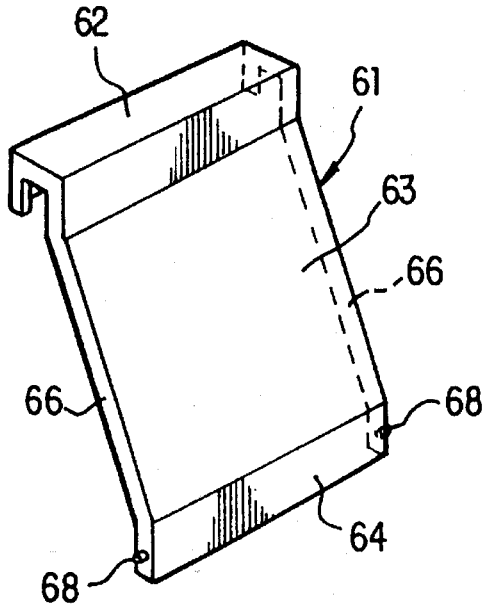
FIG. 13 is a perspective view of still another embodiment of a guide slope plate according to the invention.
Figure 14:
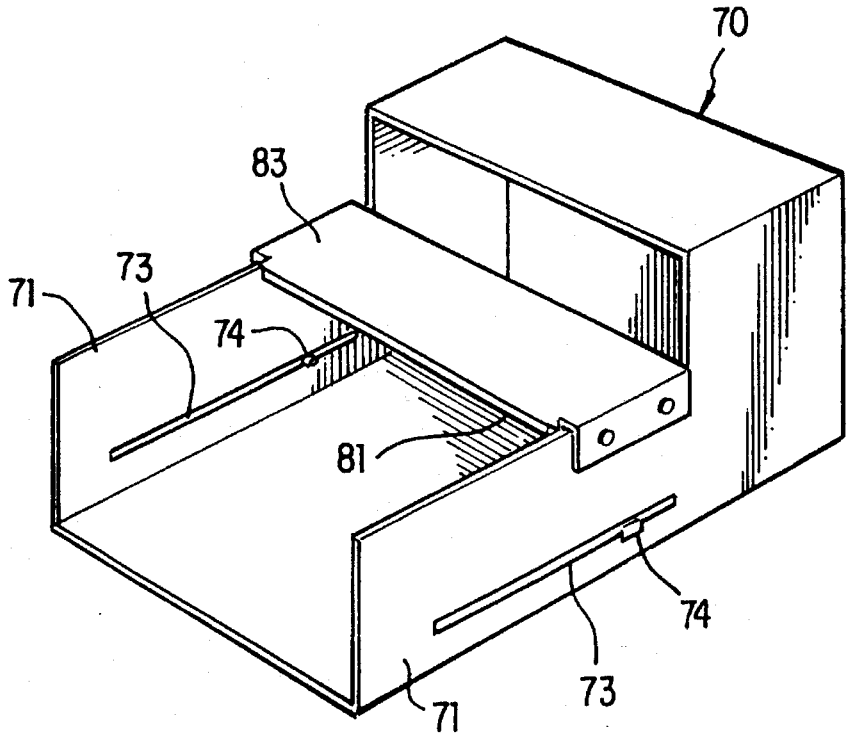
FIG. 14 is a perspective view of a further embodiment of a guide bracket according to the invention.

FIG. 12A shows the guide slope plate 61 which is moving forward and FIG. 12B shows the guide slope plate 61 which is completely moved forward and thus comes into contact with the connecting plate 82. FIG. 12C shows the guide slope plate 61 which is forcedly pushed rearward by an hand of the user after the slope plate 61 has been completely moved forward. As illustrated in FIG. 12C, when the guide slope plate 61 is forcedly pushed rearward, the guide slope plate 61 is slightly bent rearward and then the protrusions 67 formed at the lower ends of the side plates 66 are fitted into the fitting holes 84, thereby preventing the slope plate 61 from being further deformed rearward (see an enlarged circle portion 12D as in FIG. 12D).

Upon releasing the external force applied to the guide slope plate 61, the slope plate 61 is returned to its original position due to its elastic restoring force, so that opening movement of the lower shutter, that is, the rearward movement of the slope plate 61 may not be influenced by a bad effect.

Referring to FIGS. 13 to 15C, there are shown a further embodiment of means for preventing deformation of the guide slope plate according to the invention. As shown in the drawings, the guide slope plate 61 is provided at lower ends of side plates **66*a* thereof with protrusions 68 and 68 extending outward, and the side walls 71 of the guide bracket 70 is formed with elongated holes 73 and 73 at a height corresponding to that of the protrusions 68 so that the protrusions 68 are fitted into the elongated holes 73 and moved back and forth. The side plates 66*a* of the slope plate 61 is designed to have widths narrower than those of the side plates 66 described in the just above embodiment. The elongated holes 73 is formed at lower sides thereof with cut portions 74 and 74 such that the protrusions 68 are fitted into the cut portions 74 when the guide slope plate 61** is completely moved forward.

Figure 15A:
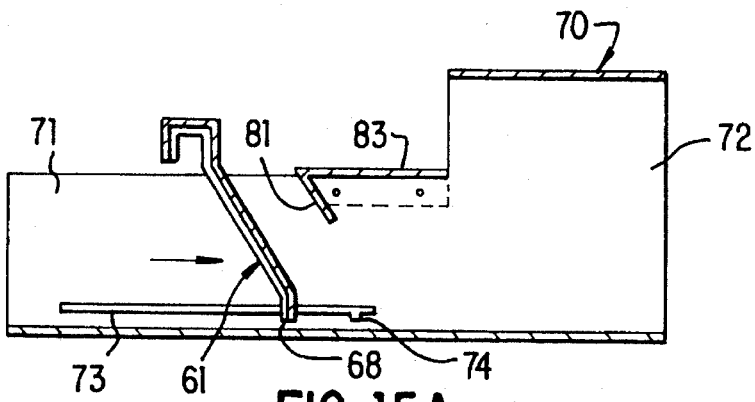
FIGS. 15A to 15C are sectional views showing guiding operation of the guide plate shown in FIG. 13 and the guide bracket shown in FIG. 14.

The above-constructed means for preventing deformation of slope plate is operated as follows. As illustrated in FIG. 15A, the protrusions 68 of the guide slope plate 61 is inserted in the elongated holes 73 formed at the side walls 71 of the guide bracket 70. In this condition, as the guide slope plate 61 is moved to the food discharging outlet 72, the protrusions 68 is moved along the elongated holes 73 formed at the side walls 71 of the guide bracket 70.

Figure 15B:
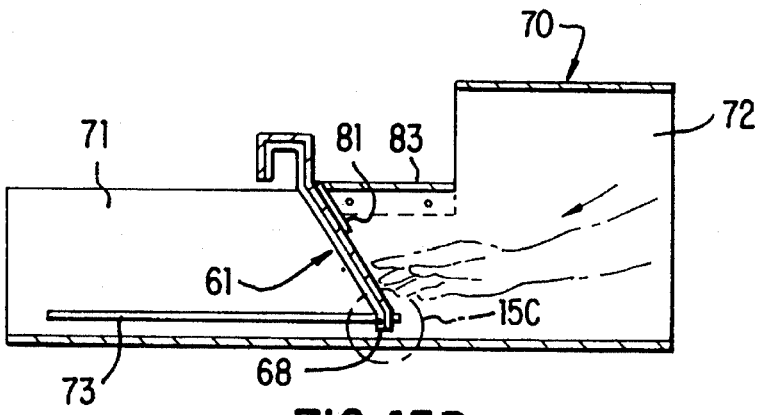
Figure 15C:
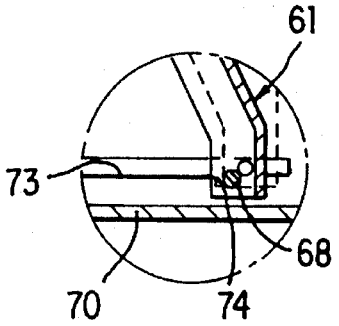

Thereafter, when the guide slope plate 61 is forcedly pushed in the direction of arrow by an hand of the user as shown in FIG. 15B, the guide slope plate 61 is slightly bent rearward and then the protrusions 68 formed at are fitted in the cut portions 74 formed at front portions of the elongated holes 73. Therefore, the guide slope plate 61 is prevented from being deformed (see an enlarged circle portion 15C, as in FIG. 15C).

Upon releasing the external force applied to the guide slope plate 61, the guide slope plate 61 is returned to the its original position due to its elastic restoring force, so that the rearward movement of the slope plate 61 may not be influenced by a bad effect.

As apparent from the above description, since the lower shutter which is adapted to open and close the lower outlet of the heating unit is attached to the guide slope plate so that an article of food fallen from the heating unit is pushed to the discharging outlet by the slope plate when the lower shutter is moved forward and closes the lower outlet of the heating unit, the user can easily take out the article of the discharging outlet, thereby providing the user with convenience in use.

Also, since height of the guide bracket can be decreased because the guide slope plate is not required to have a rapid inclined angle of 45° or more, it is possible to increase height of the food stacking receptacles and thus receptive capacity of food, as compared with the same sized vending machine, thereby facilitating maintenance of the vending machine.

Furthermore, the invention can prevent the guide slope plate from being deformed, whereby articles of food can be smoothly discharged.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An apparatus for guiding food discharged from an automatic vending machine which has a freezing storage part including a stacking receptacle for receiving food and a chute for directing the food from the stacking receptacle downwardly, and a heating and discharging part including a heating unit for heating the food fallen through the chute, upper and lower shutters for opening and closing an upper inlet and a lower outlet of the heating unit, respectively and a food discharging outlet for discharging heated food outwardly from the lower outlet, said apparatus comprising:

a guide plate fixed to and depending from a front end of the lower shutter, and adapted to be moved back and forth with the lower shutter to guide the heated food from the lower outlet to the food discharging outlet; and a guide bracket provided under the heating unit, which is adapted to guide the guide plate and the food.

2. An apparatus according to claim 1, wherein said guide plate has a fixing portion adapted to be fixed to the front end of the lower shutter, a sloped portion extending forwardly and downwardly from the fixing portion, and a pusher portion integrally formed with the sloped portion and bent downwardly therefrom.

3. An apparatus according to claim 2, wherein said guide plate has reinforcing plates attached to both ends of the fixing portion to reinforce the guide plate.

4. An apparatus according to claim 1, wherein said guide bracket has side walls spaced from each other at a predetermined distance and a discharging outlet defined at its front end.

5. An apparatus according to claim 4, wherein said guide bracket has a connecting plate attached to middle portions of upper ends of the side walls thereof.

6. An apparatus according to claim 5, wherein said connecting plate is provided at a rear end thereof with an inclined plate which has an inclined angle equal to that of the slope portion of the guide plate and is adapted to come into contact at its whole surface with the slope portion.

7. An apparatus according to claim 6, wherein said inclined plate is integrally formed with the connecting plate attached to middle portions of upper ends of the side walls of the guide bracket.

8. An apparatus according to claim 1, wherein said guide plate is formed at a lower end of a side plate thereof with a protrusion and the guide bracket is formed at a bottom thereof with a fitting hole so that the protrusion is fitted into the fitting hold when the guide plate is completely moved forward.

9. An apparatus according to claim 1, wherein said guide plate is disposed at a lower end of a side plate thereof with a protrusion and the guide bracket is disposed at side walls thereof with an elongated hole so that the protrusion is fitted into a predetermined portion of the elongated hole when the guide plate is completely moved forward.

* * * * *